US008869701B2

(12) United States Patent
Aw et al.

(10) Patent No.: US 8,869,701 B2
(45) Date of Patent: Oct. 28, 2014

(54) CARTRIDGED PROJECTILE

(75) Inventors: Cheng Hok Aw, Singapore (SG); Chee Keong Yak, Singapore (SG); Soo Chew Sie, Singapore (SG); Renjie Xie, Singapore (SG)

(73) Assignee: Advanced Material Engineering Pte Ltd, Singapore (SG)

( * ) Notice: Subject to any disclaimer, the term of this patent is extended or adjusted under 35 U.S.C. 154(b) by 0 days.

(21) Appl. No.: 13/989,063

(22) PCT Filed: Sep. 26, 2011

(86) PCT No.: PCT/SG2011/000333

§ 371 (c)(1),
(2), (4) Date: May 30, 2013

(87) PCT Pub. No.: WO2012/071011

PCT Pub. Date: May 31, 2012

(65) Prior Publication Data

US 2013/0239836 A1 Sep. 19, 2013

(30) Foreign Application Priority Data

Nov. 25, 2010 (SG) ..... 201008734-4

(51) Int. Cl.
*F42B 5/02* (2006.01)
*F42B 5/285* (2006.01)

(52) U.S. Cl.
CPC .. *F42B 5/02* (2013.01); *F42B 5/285* (2013.01)
USPC ..... 102/439; 102/430; 102/469; 102/470; 86/18; 86/19.5

(58) Field of Classification Search
CPC ..... F42B 5/00; F42B 5/02; F42B 5/285
USPC ..... 102/430, 439, 443, 444, 445, 446, 447, 102/464, 469, 470, 472, 376, 482, 487; 86/10, 18, 19.5, 23
See application file for complete search history.

(56) References Cited

U.S. PATENT DOCUMENTS 3,771,451 A * 11/1973 Woodring ..... 102/430
4,969,397 A * 11/1990 Gunther et al. ..... 102/233

(Continued)

FOREIGN PATENT DOCUMENTS

DE 102009048365 B3 10/2010
RU 002083945 C1 7/1997
WO WO 2012/071011 A1 * 5/2012

OTHER PUBLICATIONS

International Search Report of international patent application No. PCT/SG2011/000333 completed on Dec. 23, 2011 and mailed Dec. 23, 2011 (3 pages).

*Primary Examiner* — James Bergin
(74) *Attorney, Agent, or Firm* — Pyprus Pte Ltd

(57) ABSTRACT

The present invention describes an improved cartridged projectile (100). The cartridged projectile (100) comprises a projectile (110) seating at a mouth of a cartridge case (130). The cartridge case (130) has a base (134) that houses a high pressure chamber (150). A side of the high pressure chamber (150) is capped by a pressure disc (170), which is secured onto the base of the cartridge case by a nozzle ring (160). The nozzle ring (160) has a tapered or conical surface that allows the pressure disc (170) to flex, and a surface (171) of the pressure disc (170) exterior of the high pressure chamber has intersecting V-shaped grooves (172). When propellant in the high pressure chamber (150) is burned efficiently, high pressure gases developing inside the high pressure chamber cause the pressure disc (170) to rupture at a predetermined pressure along the grooves (172) so that the gases propel the projectile (110) out of a barrel at a higher speed of about 100 m/s or more.

11 Claims, 3 Drawing Sheets

(56) References Cited

U.S. PATENT DOCUMENTS

| | | | | |
|---|---|---|---|---|
| 6,041,712 | A | 3/2000 | Lyon | |
| 6,832,557 | B2 * | 12/2004 | Torsten | 102/439 |
| 7,004,074 | B2 | 2/2006 | Van Stratum | |
| 7,287,475 | B2 * | 10/2007 | Brunn | 102/444 |
| 8,186,274 | B2 * | 5/2012 | Van Stratum | 102/470 |
| 8,505,456 | B2 * | 8/2013 | Haeselich | 102/443 |

* cited by examiner

CARTRIDGED PROJECTILE

FIELD OF INVENTION

The present invention relates to an improved cartridged projectile, which projectile is capable of being projected over an extended range without increasing the amount of propellant. In particular, the invention employs a pressure disc to regulate burning of propellant and then discharging the resultant propellant gases to propel the projectile through a barrel of a weapon to a higher muzzle speed of about 100 m/s or more.

BACKGROUND

Cartridged projectile typically refers to a projectile seated at a mouth of a cartridge case, which contains a propellant. Ignition of the propellant is typically by percussion or electric means. When the propellant burns, it generates high pressure gases within the cartridge case. The high pressure gases are then vented to a low pressure chamber located behind the projectile to eject the projectile from the cartridge case and then propel the projectile through a barrel of the weapon.

It is known that high pressure containment in the cartridge case is necessary for complete and reliable burning of the propellant. Attempts have been made to provide pressure containment in the cartridge case. For example, U.S. Pat. No. 7,004,074, assigned to Martin Electronics, describes a hemispherical burst cap 14 disposed at the mouth of a cartridge case 12; this is shown in FIG. 1. An inside surface of the hemispherical burst cap 14 has embossed lines. In use, after the propellant is ignited, pressure in the cartridge case 12 builds up to many atmospheres until the embossed lines on the burst cap 14 rupture. The high pressure gases are then vented in a metered manner through the ruptured burst cap to propel the projectile 10 through the gun barrel. However, it appears that pressure containment of this cartridge case has reached its limit and this cartridged projectile can only reach a conventional muzzle speed of up to about 75 m/s.

There is a need to provide an improved cartridged projectile that can reach a higher muzzle speed of about 100 m/s or more. A higher speed projectile will have a trajectory that is flatter than a low velocity projectile; this translates to improved accuracy with a higher speed projectile. However, the higher speed projectiles must retain the profiles of conventional projectiles so that they are usable on existing weapons. At the same time, recoil on the weapon must be acceptable for handheld weapons.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention provides a cartridged projectile, which projectile is designed to be fired out of a barrel of a weapon at a higher muzzle velocity of about 100 m/s or more with a corresponding increase in range without increasing the amount of propellant.

In one embodiment, the present invention provides a cartridged projectile comprising: a hollow cartridge case extending from a base; wherein said base comprises a high pressure chamber formed therein; a threaded hole in communication with the high pressure chamber, with said threaded hole opening into a low pressure chamber defined by an interior of said cartridge case and a rear end of a projectile seated at a mouth of said cartridge case; and a shoulder between the high pressure chamber and the threaded hole; a nozzle ring with an inner surface comprising a tapered or conical bore, with the narrower end of said tapered bore opening into a discharge hole, so that said nozzle ring is seated in said threaded hole and said discharge hole opens into said low pressure chamber; and a pressure disc disposed between said shoulder and said nozzle ring, with a surface of said pressure disc facing the tapered bore being scribed with intersecting V-shaped cross-sectional grooves.

In one embodiment of the pressure disc, the pressure disc is round and flat and has a thickness T ranging from about 5% to about 10% of its diameter. The vertex at the base of said V-shaped grooves form an angle ranging from about 30 degree to about 120 degree, preferably about 60 degree. Preferably, the depth d of the V-shaped grooves is substantially half the thickness T.

In another embodiment, the present invention provides a method of propelling a projectile through a barrel to a higher speed, the method comprising: disposing a high pressure chamber within a base of a cartridge case, which is connected to a rear of said projectile; capping a side of said high pressure chamber with a flat pressure disc, wherein a surface of said pressure disc facing an exterior of said high pressure chamber has intersecting grooves of V-shaped cross-section; and clamping said pressure disc to said base of said cartridge case by a nozzle ring, with an inner surface of said nozzle ring adjacent said pressure disc being tapered or conical; wherein after propellant in said high pressure chamber is ignited, pressure in said high pressure chamber builds up and the pressure disc is allowed to flex into the tapered or conical space of said nozzle ring such that after said propellant is burned, stress concentrations at said V-shaped grooves cause said pressure disc to rupture and high energy gases at the rear of said projectile propel it out of said barrel at a speed of 100 m/s or more.

BRIEF DESCRIPTION OF THE DRAWINGS

This invention will be described by way of non-limiting embodiments of the present invention, with reference to the accompanying drawings, in which.

DETAILED DESCRIPTION

Figure 1:
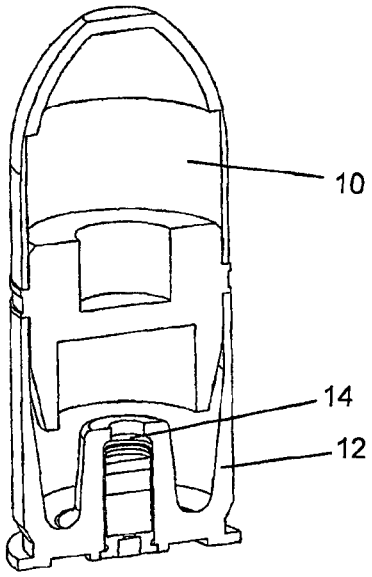
FIG. 1 (prior art)
FIG. 1 illustrates a known cartridged projectile according to U.S. Pat. No. 7,004,074.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

Figure 2:
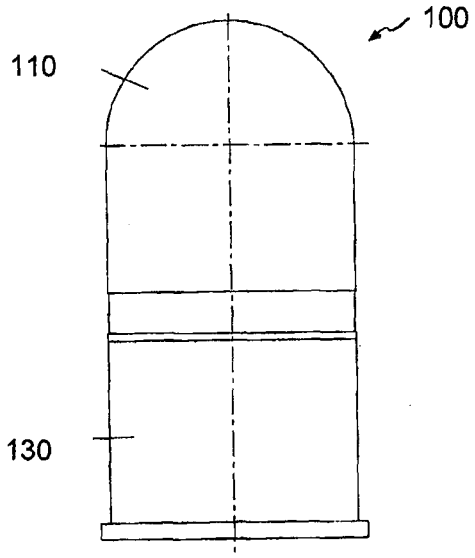
FIG. 2 illustrates a cartridged projectile according to an embodiment of the present invention.

FIG. 2 shows a cartridged projectile 100 according to an embodiment of the present invention. As shown in FIG. 2, the cartridged projectile 100 is made up of a projectile 110 connected to a mouth of a cartridge case 130 such that there is a space 120 (shown in FIG. 3) bounded by the mouth of the cartridge case and a rear end of the projectile 110. The space 120 is referred to as a low pressure chamber.

Figure 3:
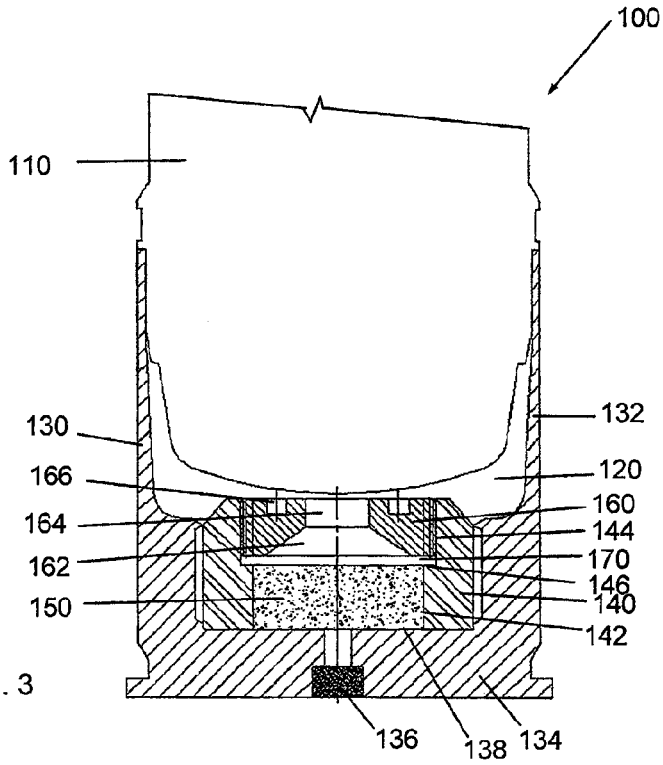
FIG. 3 illustrates a sectional view of a cartridge case for use with the projectile shown in FIG. 2.

As shown in FIG. 3, the cartridge case 130 is substantially a hollow cylindrical shell 132 that extends from a base 134. At a centre of the base 134, there is a stepped hole 136 piercing through a thickness of the base and extending along a longitudinal axis of the cartridged projectile 100, with the larger of the stepped hole 136 opening to the outside of the base 134. From the inside of the cartridge case 130, there is a flat-bottom threaded bore 138 that is in communication with the stepped hole 136. The threaded bore 138 receives a pressure containment ring 140. The inside surface of the pressure containment ring 140 comprises a hole 142 and a threaded hole 144 relatively larger than the hole 142. Due to difference in sizes of the hole 142 and threaded hole 144, a shoulder 146 is formed between the hole 142 and threaded hole 144; preferably, the hole 142 and threaded hole 144 are substantially coaxial with the longitudinal axis of the cartridged projectile 100. The threaded hole 144 in turn receives a nozzle ring 160. The inner surface of the nozzle ring 160 consists of a tapered or conical bore 162 and a discharge hole 164 joined to the smaller end of the tapered bore 162 so that the discharge hole 164 opens into the low pressure chamber 120. On a face of the nozzle ring 160 that is adjoining the low pressure chamber 120, there are two diametrally opposed blind holes 166; these blind holes 166 are for engagement with pegs on a tool (not shown in the figures) to turn the nozzle ring 160 into the pressure containment ring 140. Similarly, there are two holes (not shown in the figures) on a front end of the pressure containment ring 140 for engagement with pegs on a tool to turn the pressure containment ring 140 into the base 134 of the cartridge case 130. Clamped between the nozzle ring 160 and the shoulder 146 is a round, flat pressure disc 170. The space bound by the pressure disc 170, surfaces of the hole 142 and base 134 of the cartridge case defines a high pressure chamber 150. In use, the high pressure chamber 150 is filled with a propellant.

Figure 4A:
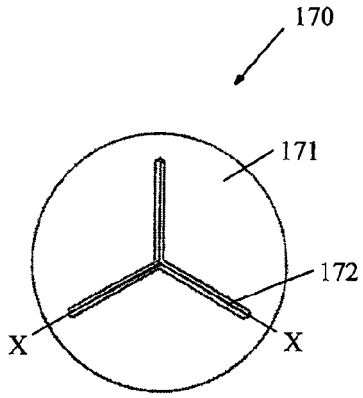
FIG. 4A illustrates a pressure disc according to another embodiment of the present invention.

FIG. 4A shows a pressure disc according to an embodiment of the present invention. As shown in FIG. 4A, the pressure disc 170 has a surface 171 that is scribed with V-sectional grooves 172. In one embodiment, vertex of the V shape of the groove 172 has an angle $\alpha$ of about 60 degrees. Other angles $\alpha$ between about 30 and 120 degrees are also possible. As shown in FIG. 4A, the grooves 172 form a pattern with three segments intersecting near the centre of the pressure disc 170. FIG. 4B shows a sectional view of the pressure disc 170 along line XX. In another embodiment, the pressure disc 170 is made of brass having a tensile strength of about 470 MPa and an elongation of about 22%; in practice, the elongation may range from about 20% to about 25%. Preferably, the groove 172 has a depth d of substantially half a thickness T of the pressure disc 170. Generally, the thickness T of the pressure disc 170 ranges from about 5% to about 10% of its diameter depending on the calibre of the cartridged projectile 100. For example, for a 40 mm projectile, the pressure disc 170 is about 20 mm in diameter and has a thickness of about 1 mm, whilst the discharge hole 164 is about 14 mm in diameter. When assembled, the grooved surface 171 of the pressure disc 170 is facing the tapered bore 162, i.e. the grooved surface 171 is on the low pressure chamber's side.

Figure 5:
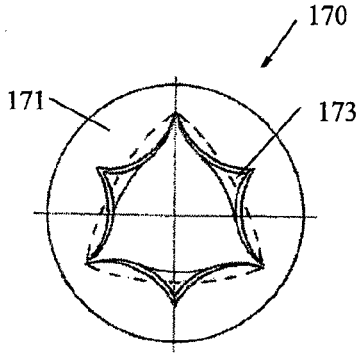
FIG. 5 illustrates a ruptured pressure disc of the present invention.

The stepped hole 136 at the base of the cartridge case 130 is filled with a priming charge. In use, after the priming charge is activated, the propellant in the high pressure chamber 150 burns and pressure builds up rapidly within the high pressure chamber 150. As a result, the pressure disc 170 is flexed outward into the tapered or conical bore 162; this causes the V-shaped grooves 172 on the pressure disc 170 to experience high tensile stresses. By interplay of material of the pressure disc 170, stress concentrations at the grooves 172, amount of propellant and volume of the high pressure chamber 150, the pressure disc 170 is designed to rupture at a predetermined pressure when the propellant is burned completely. From tests on the cartridged projectile 100, it was observed that rupture of the pressure disc 170 usually started from the centre of the pressure disc 170 where the grooves 172 intersect; as pressure in the high pressure chamber 150 builds up, stress concentrations at the centre of the pressure disc 170 cause stresses at the V-shaped tips of the grooves 172 to reach the tensile stress of the pressure disc and this results in rupture of the pressure disc 170. The energy of the high pressure gases discharging through the ruptured pressure disc 170 and discharge hole 164 then causes complete rupture of the pressure disc 170 along the grooves 172. The ruptured centre of the pressure disc 170 is deformed into three outward projecting petals 173, as shown in FIG. 5. The energy of the high pressure gases discharging through the ruptured pressure disc 170 also forces the petals 173 to overlay the surface of the tapered bore 162. In this way, the petals 173 form a nozzle around the tapered bore 162 and the gases in the high pressure chamber 150 are throttled out through the bore 162,164 into the low pressure chamber 120. With the pressure disc 170 of the present invention, burn efficiency of the propellant is significantly increased; this allowed higher pressure buildup in the high pressure chamber 150; together with the effect of the conical bore of the nozzle ring 160 of the present invention, the muzzle velocity of the cartridged projectile 110 reaches or exceeds 100 m/s.

With a higher muzzle velocity of 100 m/s, the range of the projectile according to the present invention is correspondingly extended from a conventional range of about 400 m to an extended range of about 600 m whilst recoil is still kept at a manageable level for handheld weapons. Table 1 below is an extract of the US Army's training manual, TOP 3-2-504 showing the firing limitations for hand and shoulder weapons:

TABLE 1

| Computed Recoil Energy | Limitations on Rounds fired |
|---|---|
| Less than 15 foot-lb (20.3 joules) | Unlimited firing |
| 15 to 30 ft-lb (20.3 to 40.7 joules) | 200 rounds/day/man |
| 30 to 45 foot-lb (40.7 to 61.0 joules) | 100 rounds/day/man |
| 45 to 60 foot-lb (61.0 to 81.4 joules) | 25 rounds/day/man |
| Greater than 60 foot-lb (81.4 joules) | No shoulder firing |

From test firing using the cartridged projectiles 100 of the present invention, recoil energy of about 30 joules was recorded; in contrast, conventional cartridged projectiles fired on the same weapon generate recoil energy of about 19.6 joules. The test data prove that by providing the pressure disc 170 of the present invention, the muzzle velocity of the cartridged projectiles 100 is increased to about 100 m/s with a corresponding increase in firing range to about 600 m yet generating a sustainable recoil energy that allows one to fire about 200 rounds/day with a handheld weapon.

Figure 4C:
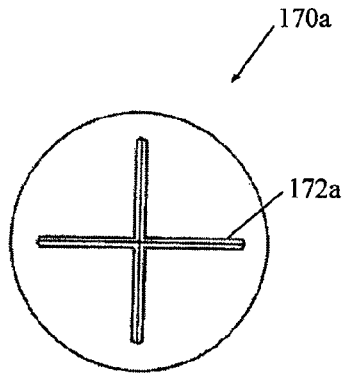
FIG. 4C illustrates another embodiment of the pressure disc.
Figure 4B:
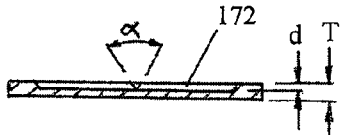
FIG. 4B illustrates section view XX of the pressure disc shown in FIG. 4A.

FIG. 4C shows a pressure disc according to another embodiment of the present invention. As shown in FIG. 4C, the pressure disc 170*a* has grooves 172*a* that intersect like a cross. Again, the grooves 172*a* are V-shaped in cross-section. A cross pattern of the grooves results in four petals 173 on a ruptured pressure disc; however, the four petals are not always consistently symmetrical about the centre of the pressure disc 170*a*. Whilst the planar pattern of the grooves 172 does not affect the performance of the cartridged projectile 110, grooves 172 with 3 radiating segments are preferred.

From FIG. 3, a reader will notice that the rear end of the cartridge case 130 is substantially solid in structure. The cartridge case 130 of the present invention is therefore provided to withstand higher pressure buildup in the high pressure chamber 150 as a result of providing the pressure disc 170,170*a*. In one embodiment, the pressure containment ring 140 or nozzle ring 160 is made of aluminium. In another, the pressure containment ring 140 or nozzle ring 160 is made of steel. Selection of either material for the containment ring 140 or nozzle ring 160 depends on the weight of material and centre of gravity of the cartridged projectile 100 to achieve predetermined ballistic performance.

Figure 6:
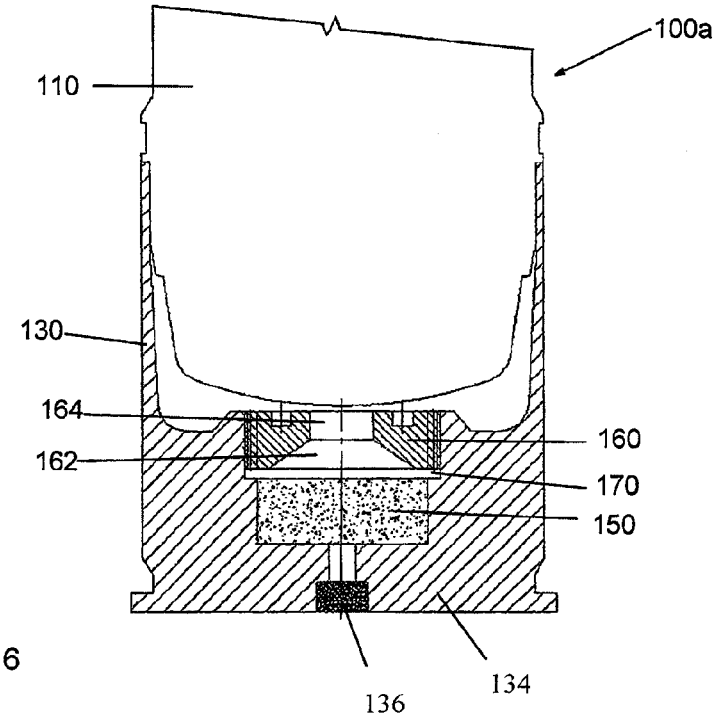
FIG. 6 illustrates a sectional view of a cartridge case according to another embodiment of the present invention.

FIG. 6 shows a cartridge case according to another embodiment of the present invention. As shown in FIG. 6, the pressure containment ring 140 is integrally formed with the base 134 of the cartridge case 130. This embodiment helps to reduce both costs and number of parts in the manufacture of the cartridge case 130 and cartridged projectile 100.

An advantage of the present invention is that the overall dimensions of the cartridge case 130 remain the same as those of a conventional cartridge case. This means that the cartridge case 130 according to the present invention is suitable to fit with all existing types of projectiles without any need for design modifications. This also means that projectiles fitted with cartridge cases 130 of the present invention can be used with existing weapons and existing production processes need not be drastically changed to produce these cartridged projectiles 100.

While specific embodiments have been described and illustrated, it is understood that many changes, modifications, variations and combinations thereof could be made to the present invention without departing from the scope of the invention. For example, the pressure disc 170,170*a* may be made of steel having a tensile strength range of about 400 MPa to about 520 MPa and elongation of between about 20% and 25%. In another example, the pressure disc is made from aluminium having similar tensile strength and elongation properties.

The invention claimed is:

1. A cartridged projectile comprising:

a hollow cartridge case extending from a base; wherein said base comprises a high pressure chamber formed therein;

a threaded hole in communication with the high pressure chamber, with said threaded hole opening into a low pressure chamber defined by an interior of said cartridge case and a rear end of a projectile seated at a mouth of said cartridge case; and a shoulder between the high pressure chamber and the threaded hole;

a nozzle ring with an inner surface comprising a tapered or conical bore, with the narrower end of said tapered bore opening into a discharge hole, so that said nozzle ring is seated in said threaded hole and said discharge hole opens into said low pressure chamber; and a pressure disc disposed between said shoulder and said nozzle ring, with a surface of said pressure disc facing the tapered bore being scribed with intersecting V-shaped cross-sectional grooves.

2. A cartridged projectile according to claim 1, wherein said pressure disc is round and flat, and has a thickness ranging from about 5% to about 10% of its diameter.

3. A cartridged projectile according to claim 2, wherein a depth d of said V-shaped grooves is substantially half said thickness T of said pressure disc.

4. A cartridged projectile according to claim 1, wherein a vertex at the base of said V-shaped grooves forms an angle $\alpha$ ranging from about 30 degree to about 120 degree.

5. A cartridged projectile according to claim 4, wherein said vertex at the base of said V-shaped grooves forms an angle $\alpha$ of substantially 60 degree.

6. A cartridged projectile according to claim 1, wherein material of said pressure disc is selected from the following:

brass, steel and aluminium having tensile strength of about 400-520MPa and elongation of about 20-25%.

7. A cartridged projectile according to claim 1, wherein said V-shaped grooves form a pattern of three radiating segments or of a cross.

8. A cartridged projectile according to claim 1, wherein surface of said high pressure chamber, said shoulder and threaded hole form an inner surface of a pressure containment ring, which is threaded into said base of said cartridge case.

9. A cartridged projectile according to claim 8, wherein said nozzle ring or pressure containment ring is made from aluminium or steel.

10. A cartridged projectile according to claim 1, wherein an exterior end of said base of said cartridge case further comprises a stepped hole for housing a priming charge.

11. A method of propelling a projectile through a barrel to a higher speed, said method comprising:

disposing a high pressure chamber within a base of a cartridge case, which is connected to a rear of said projectile;

capping a side of said high pressure chamber with a flat pressure disc, wherein a surface of said pressure disc facing an exterior of said high pressure chamber has intersecting grooves of V-shaped cross-section; and clamping said pressure disc to said base of said cartridge case by a nozzle ring, with an inner surface of said nozzle ring adjacent said pressure disc being tapered or conical;

wherein after propellant in said high pressure chamber is ignited, pressure in said high pressure chamber builds up and the pressure disc is allowed to flex into the tapered or conical space of said nozzle ring such that after said propellant is burned, stress concentrations at said V-shaped grooves cause said pressure disc to rupture and high energy gases at the rear of said projectile propel it out of said barrel at a speed of 100 m/s or more.

* * * * *